US007435164B2

(12) United States Patent
Murai

(10) Patent No.: US 7,435,164 B2
(45) Date of Patent: Oct. 14, 2008

(54) GRINDING METHOD AND GRINDING DEVICE

(75) Inventor: Fukuo Murai, Aichi (JP)

(73) Assignee: Musashi Seimitsu Industry Co., Ltd., Aichi (JP)

( * ) Notice: Subject to any disclaimer, the term of this patent is extended or adjusted under 35 U.S.C. 154(b) by 138 days.

(21) Appl. No.: 10/533,450

(22) PCT Filed: Sep. 12, 2003

(86) PCT No.: PCT/JP03/11673

§ 371 (c)(1),
(2), (4) Date: Nov. 21, 2005

(87) PCT Pub. No.: WO2004/048033

PCT Pub. Date: Jun. 10, 2004

(65) Prior Publication Data

US 2006/0128280 A1 Jun. 15, 2006

(30) Foreign Application Priority Data

Nov. 26, 2002 (JP) ..... 2002-341988
Feb. 17, 2003 (JP) ..... 2003-038043

(51) Int. Cl.
*B24B 7/00* (2006.01)

(52) U.S. Cl. ..... 451/67; 451/356; 451/28; 451/41

(58) Field of Classification Search ..... 451/356, 451/344, 5–11, 28, 41, 56, 67
See application file for complete search history.

(56) References Cited

U.S. PATENT DOCUMENTS 5,220,754 A * 6/1993 Tayebi et al. ..... 451/59
5,427,644 A * 6/1995 Nagatsuka et al. ..... 156/344
5,911,257 A * 6/1999 Morikawa et al. ..... 15/88.2
6,120,363 A * 9/2000 Dunn ..... 451/356
6,173,470 B1 * 1/2001 van Osenbruggen ..... 15/180
2002/0065030 A1 5/2002 Inoue
2006/0128280 A1 * 6/2006 Murai ..... 451/67
2006/0166604 A1 * 7/2006 Murai ..... 451/5

FOREIGN PATENT DOCUMENTS

| | | |
|---|---|---|
| DE | 199 13 747 A1 | 10/2000 |
| JP | 63-312055 A | 12/1988 |
| JP | 7-24712 | 1/1995 |
| JP | 7-108306 | 4/1995 |
| JP | 7-276197 | 10/1995 |
| JP | 9-300193 | 11/1997 |
| JP | 10-296611 A | 11/1998 |

* cited by examiner

*Primary Examiner*—Lee D Wilson
(74) *Attorney, Agent, or Firm*—Arent Fox LLP

(57) ABSTRACT

To grind a peripheral surface of a rotated work (10), by a rotary grindstone (22) rotated by a wheel spindle 21, a rotary brush (40) is mounted to one side of the rotary grindstone (22), so that it is rotated along with the rotary grindstone (22). Subsequently to the grinding of the work (10) by the rotary grindstone (22), the rotary grindstone (22) and the work (10) are moved axially relative to each other, and a ground surface of the work (10) is brushed by the rotary brush (40), whereby the polishing of the ground surface of the work (10) is achieved. Thus, the shifting of the work as well as an exclusive deflashing device and an exclusive polishing device are not required, which can contribute to a reduction in machining cost.

8 Claims, 12 Drawing Sheets

DURING DETECTION OF STANDARD PHASE

DURING DRESSING

DURING GRINDING

DURING GRINDING

DURING BRUSHING

DURING DRESSING

DURING GRINDING

GRINDING METHOD AND GRINDING DEVICE

CROSS-REFERENCE TO RELATED APPLICATION

This application is a National Stage entry of International Application No. PCT/JP03/11673, filed Sep. 12, 2003, the entire specification claims and drawings of which are incorporated herewith by reference.

FIELD OF THE INVENTION

The present invention relates to an improvement in grinding process and apparatus for grinding an outer peripheral surface of a rotated work by a rotary grindstone rotated by a wheel spindle.

BACKGROUND ART

Such a grinding apparatus is already known, as disclosed, for example, in Patent Document 1.

[Patent Document 1]

Japanese Patent Application Laid-open No. 9-300193

A grinding flash and a grinding trace remain on a work ground by a rotary grindstone. Therefore, it is a conventional practice that the ground work is subjected to a treatment in an exclusive deflashing device and an exclusive polishing device, where the removal of a ground flash and the polishing of a ground surface are carried out. In such a method, however, a lot of labor is required for shifting the work from the grinding apparatus to the deflashing device or the polishing device, and, an equipment cost is high due to the need for the exclusive deflashing and polishing devices. For this reason, it is difficult to reduce the work-grinding cost.

DISCLOSURE OF THE INVENTION

Accordingly, the present invention has been accomplished in view of the above circumstances, and it is an object of the present invention to provide grinding process and apparatus, wherein the removal of a ground flash and the polishing of a ground surface can be conducted subsequently to the grinding of a work, whereby the shifting of the work and the exclusive deflashing and polishing devices are not required, which can contribute to a reduction in machining cost.

To achieve the above object, according to a first aspect and feature of the present invention, there is provided a process for grinding an outer peripheral surface of a rotated work by a rotary grindstone rotated by a wheel spindle, characterized in that the process comprises the steps of mounting a rotary brush to one side of the rotary grindstone so as to be rotated along with the rotary grindstone, grinding the work by the rotary grindstone and then moving the rotary grindstone and the work axially relative to each other, and brushing a ground surface of the work by the rotary brush, thereby polishing the ground surface of the work.

With the first feature, when the rotary grindstone and the work are moved axially relative to each other subsequently to the grinding of the work by the rotary grindstone, and the ground surface of the work is brushed by the rotary brush, the polishing of the ground surface can be achieved. In this manner, the grinding and the polishing can be carried out continuously and hence, the detachment of the work is not required between these treatments. Therefore, it is possible to remarkably shorten the machining time, as compared with the conventional case where a polishing step is provided specially.

This can contribute to a reduction in machining cost in cooperation with that an exclusive polishing device as used in the prior art is not required either.

According to a second aspect and feature of the present invention, there is provided a process for grinding an outer peripheral surface of a rotated work by a rotary grindstone rotated by a wheel spindle, characterized in that the process comprises the steps of mounting a rotary brush to one side of the rotary grindstone so as to be rotated along with the rotary grindstone, grinding the work by the rotary grindstone and then moving the rotary grindstone and the work axially relative to each other, and brushing end edges of a ground surface of the work by the rotary brush, thereby removing a ground flash of the work.

With the second feature, when the rotary grindstone and the work are moved axially relative to each other subsequently to the grinding of the work by the rotary grindstone, and the end edges of the ground surface of the work are brushed by the rotary brush, the removal of a ground flash can be achieved. In this manner, the grinding and the polishing can be carried out continuously and hence, the detachment of the work is not required between these treatments. Therefore, it is possible to remarkably shorten the machining time, as compared with the conventional case where a deflashing step is provided specially. This can contribute to a reduction in machining cost in cooperation with that an exclusive deflashing device as used in the prior art is not required either.

According to a third aspect and feature of the present invention, there is provided a process for grinding a peripheral surface of a rotated work by a rotary grindstone rotated by a wheel spindle, comprising the steps of mounting a rotary brush to one side of the rotary grindstone so as to be rotated along with the rotary grindstone, grinding the work by the rotary grindstone and then moving the rotary grindstone and the work axially relative to each other, and brushing the entire ground surface of the work from end edges of the ground surface by the rotary brush, thereby achieving the removal of a ground flash of the work and the polishing of the ground surface.

With the third feature, the removal of the ground flash of the work and the polishing of the ground surface can be achieved by moving the rotary grindstone and the work axially relative to each other subsequently to the grinding of the work by the rotary grindstone and brushing the entire ground surface of the work from the end edges of the ground surface of the work by the rotary brush. In this manner, the grinding, the deflashing and the polishing can be carried out continuously and hence, the detachment of the work is not required between these treatments. Therefore, it is possible to remarkably shorten the machining time, as compared with the conventional case where a deflashing step and a polishing step are provided specially. This can contribute to a reduction in machining cost in cooperation with that an exclusive deflashing device and an exclusive polishing device as used in the prior art are not required either.

According to a fourth aspect and feature of the present invention, there is provided a grinding apparatus including a rotary grindstone mounted to a wheel spindle to grind an outer peripheral surface of a work by the rotation of the rotary grindstone, characterized in that a rotary brush is mounted adjacent to the rotary grindstone for brushing the work having a diameter larger than that of the rotary grindstone and ground by the rotary grindstone.

With the fourth feature, the removal of a ground flash and the polishing of a ground surface of the work can be achieved reliably by the brushing using the rotary brush by only moving the rotary grindstone and the work axially relative to each other subsequently to the grinding the outer peripheral surface of the work by the rotary grindstone. The detachment of the work is not required between these treatments and hence, it is possible to remarkably shorten the machining time. This can contribute to a reduction in machining cost in cooperation with that an exclusive deflashing device and an exclusive polishing device are not required either.

According to a fifth aspect and feature of the present invention, in addition to the fourth feature, the rotary brush is formed into a variable-diameter type, so that when the wheel spindle is rotated at a low speed lower than a grinding rotational speed of the rotary grindstone, the diameter of the rotary brush is smaller than that of the rotary grindstone, but when the wheel spindle is rotated at a speed equal to the grinding rotational speed, the diameter of the rotary brush is larger than that of the rotary grindstone.

With the fifth feature, in the dressing of the rotary grindstone carried out at the low-speed rotation, the rotary brush is contracted to the diameter smaller than the diameter of the rotary grindstone, whereby the interference of the rotary brush and a dresser with each other can be avoided. In the grinding of the work, the rotary brush is expanded to the diameter larger than that of the rotary grindstone, whereby the removal of the ground flash and the polishing of the ground surface can be carried out substantially simultaneously with the grinding.

According to a sixth aspect and feature of the present invention, in addition to the fifth feature, the rotary brush is comprised of a brush body mounted adjacent to the rotary grindstone, and a brush element wire embedded in an outer periphery of the brush body, the brush element wire having contraction and expansion properties provided thereto, so that when the brush element wire is in a free state, the brush element wire is in a contracted state in which the diameter of the rotary brush is smaller than that of the rotary grindstone, and when the wheel spindle is rotated at a predetermined rotational speed or more, the brush element wire is expanded by a centrifugal force, whereby the diameter of the rotary brush is larger than that of the rotary grindstone.

With the sixth feature, the rotary brush can be formed into the variable-diameter type by an extremely simple measure that the contraction and expansion properties are provided to the brush element wire.

According to a seventh aspect and feature of the present invention, in addition to the sixth feature, a single or a plurality of resilient bent portions are formed on the brush element wire to provide the contraction and expansion properties to the brush element wire.

With the seventh feature, the contraction and expansion properties can be provided to the brush element wire by an extremely simple measure that the resilient bent portion is formed on the brush element wire and thus, it is possible to provide the rotary brush of the diameter-variable type at a low cost.

According to an eighth aspect and feature of the present invention, in addition to the fifth feature, the rotary brush is comprised of a brush body mounted adjacent to the rotary grindstone, and a brush element wire embedded in an outer periphery of the brush body, the brush element wire being disposed so that when the brush element wire is in a free state, the brush element is inclined with respect to a radius line of the brush body, so that the diameter of the rotary brush is smaller than that of the rotary grindstone, but when the wheel spindle is rotated at a predetermined rotational speed or more, the brush element wire is allowed to rise toward the radius line by a centrifugal force, so that the diameter of the rotary brush is larger than that of the rotary grindstone.

With the eighth feature, the rotary brush can be formed into a diameter-variable type with an extremely simple structure in which the brush element wire is disposed in an inclined state and thus, the rotary brush can be provided at a low cost.

The above and other objects, features and advantages of the invention will become apparent from the following description of the preferred embodiments taken in conjunction with the accompanying drawings.

BEST MODE FOR CARRYING OUT THE INVENTION

The present invention will now be described by way of preferred embodiments with reference to the accompanying drawings.

Figure 1:
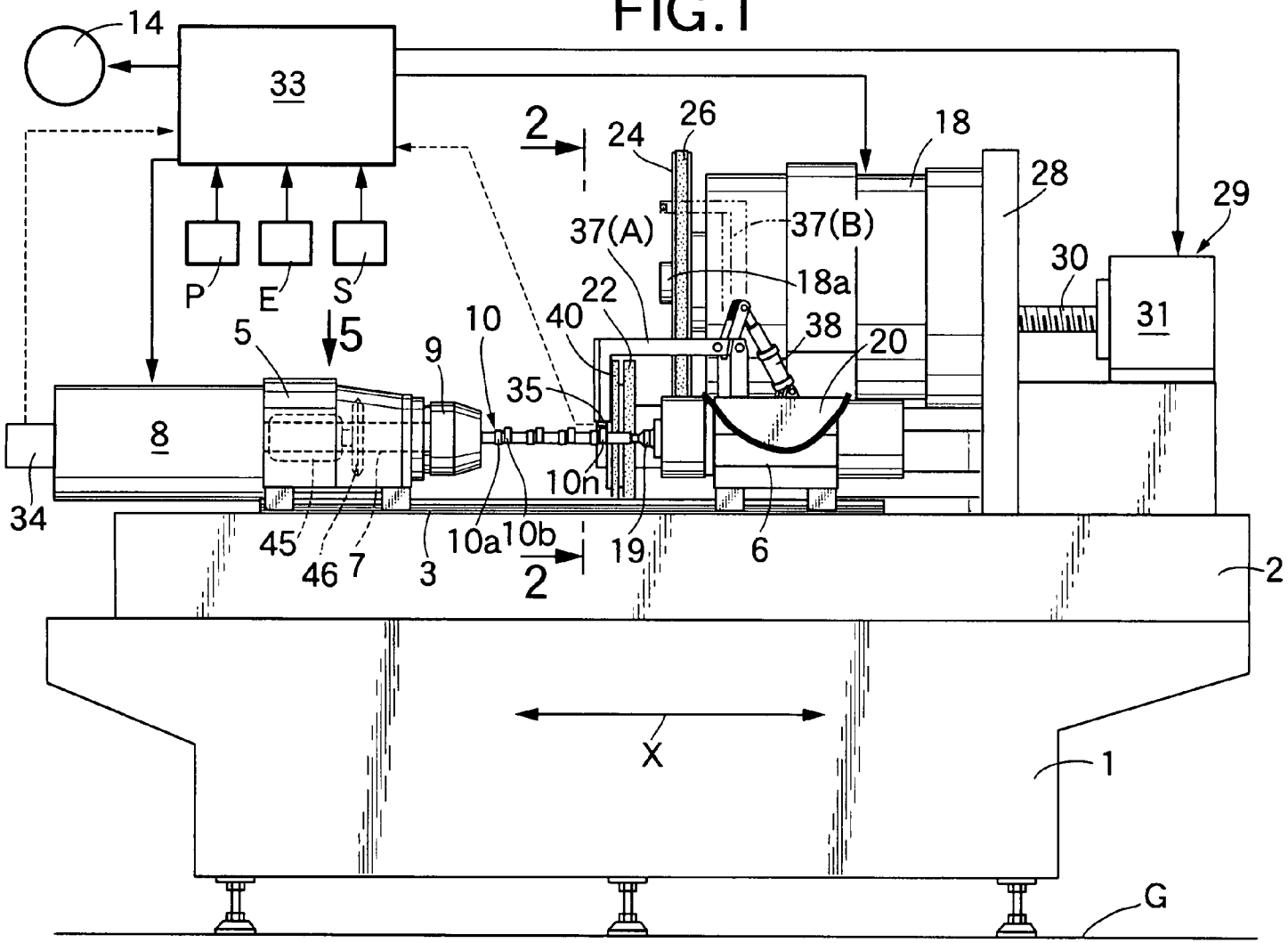
FIG. 1 is a front view of a camshaft-grinding apparatus according to a first embodiment of the present invention.
Figure 2:
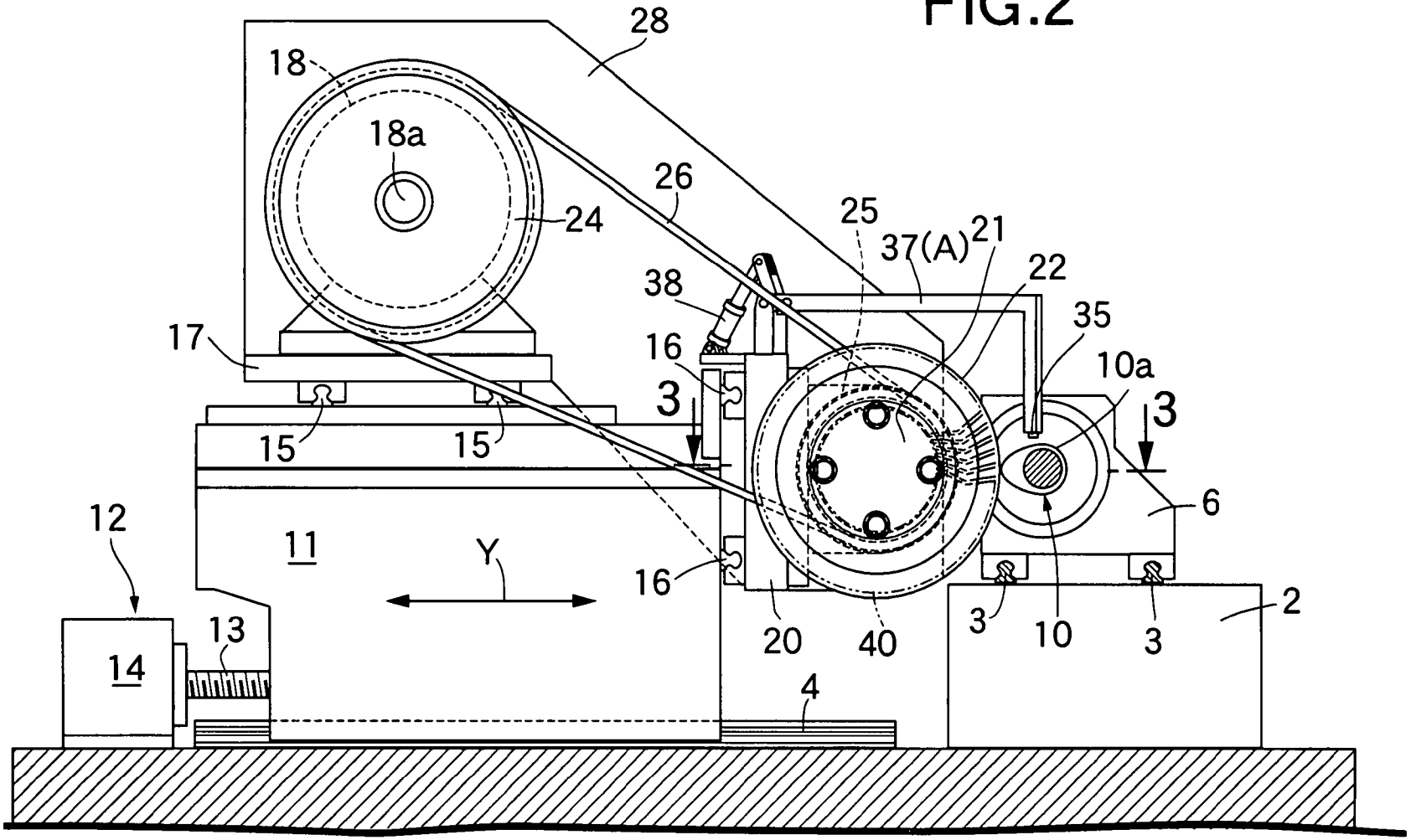
FIG. 2 is an enlarged sectional view taken along a line 2-2 in FIG. 1.

A first embodiment of the present invention will first be described. Referring to FIGS. 1 and 2, an X-direction rail 3 is formed on a table 2 on a machine base 1 placed on a floor G to extend in an X-direction, and a Y-direction rail 4 is formed on an upper surface of the machine base 1 to extend in a Y-direction perpendicular to the X-direction. A head stock 5 and a tail stock 6 are mounted on the X-direction rail 3, so that they can be moved toward and away from each other. A main spindle 7 is carried in the head stock 5, and a first electric motor 8 for rotating the main spindle 7 is mounted to the head stock 5 and connected to an outer end of the main spindle 7. A chuck 9 is mounted to an inner end of the main spindle 7.

The table 2 is provided with a tail stock 19 for supporting a work 10 for a non-circular rotor by cooperation with the chuck 9 of the head stock 5. The work 10 for the non-circular rotor is a valve-operating camshaft in a multi-cylinder engine, in the case of the illustrated example, and includes a plurality of cams 10*a*, 10*b* - - - 10*n* which are arranged at predetermined distances in an axial direction, and each of which comprises a base circle portion 50 having a constant curvature radius, and a cam lobe 51 leading to circumferentially opposite ends of the base circle portion 50 (see FIG. 4). The cams 10*a*, 10*b* - - - 10*n* are different in phases from one another. The camshaft 10is formed by a precision casting, and outer peripheral surfaces of the plurality of cams 10*a*, 10*b* - - - 10*n* are to be ground.

A movable table 11 is slidably mounted on the Y-direction rail 4, and a movable table-driving means 12 capable of reciprocally move the movable table 11 along the Y-direction rail 4 is mounted between the table 2 and the movable table 11. The movable table-driving means 12 is comprised of a screw shaft 13 disposed in the Y-direction and threadedly engaged with the movable table 11, and a second electric motor 14 mounted to the table 2 and capable of rotating the screw shaft 13 in opposite directions.

An upper surface rail 15 and a side rail 16 are formed on an upper surface and a side of the movable table 11 to extend in the X-direction, and a third electric motor 18 is mounted with its output shaft 18*a* turned in the X-direction on a motor base 17 which is slidably mounted on the upper surface rail 15. A wheel spindle 21 is carried with its axis turned in the X-direction on a wheel spindle stock 20 which is slidably mounted on the side rail 16, and a rotary grindstone 22 for grinding the outer peripheral surfaces of the cams 10*a*, 10*b* - - - 10*n* of the camshaft 10 sequentially is detachably secured to the wheel spindle 21 by a plurality of bolts 23, 23 (see FIG. 3).

The output shaft 18*a* of the third electric motor 18 and the wheel spindle 21 are connected to each other by a driving pulley 24 and a driven pulley 25 fixedly mounted on the output shaft 18*a* and the wheel spindle 21 respectively and by a belt 26 wound around the pulleys 24 and 25, so that the third electric motor 18 drives the wheel spindle 21 in rotation by its output.

The motor base 17 and the wheel spindle stock 20 are integrally connected to each other by a connecting block 28, so that they can be slid simultaneously on the upper surface rail 15 and the side rail 16. A connecting block-driving means 29 capable of reciprocally moving the connecting block 28 along the upper surface rail 15 and the side rail 16 is mounted between the connecting block 28 and the movable table 11. The connecting block-driving means 29 is comprised of a screw shaft 30 disposed in the X-direction and threadedly engaged with the connecting block 28, and a fourth electric motor 31 mounted to the movable table 11 and capable of rotating the screw shaft 30 in opposite directions.

An NC control unit 33 is mounted on the machine base 1. Inputted to the NC control unit 33 are a detection signal from a camshaft rotated-position sensor 34 mounted on the first electric motor 8 for indexing the rotated position of the camshaft 10 from the rotated position of the main spindle 7, and a detection signal from a standard phase sensor 35 for indexing the standard phase of the cam 10*a* in a predetermined position (the outermost cam 10*a* closest to the head stock 5 in the illustrated example), in addition to profile data P of the cams 10*a*, 10*b* - - - 10*n* on the camshaft 10, data E of phase difference between the cams 10*a*, 10*b* - - - 10*n* as well as data S of axial distances between the cams 10*a*, 10*b* - - - 10*n*. The NC control unit controls the operations of the first to fourth electric motors 8, 14, 18 and 31 based on these signal and data.

The standard phase sensor 35 is mounted at a tip end of a sensor-supporting arm 37 pivotally supported on the wheel spindle stock 20. The sensor-supporting arm 37 is capable of being swung between a detecting position A in which the standard phase sensor 35 is opposed to the outer peripheral surface of the outermost cam 10*a* closest to the head stock 5 and a resting position B in which the sensor 35 is spaced apart from the camshaft 10. An electromagnetic or electric actuator 38 is connected to the sensor-supporting arm 37 for swinging the sensor-supporting arm 37 between the two positions A and B.

When the cam 10*a* has been rotated from the base circle portion 50 toward the cam lobe 51 relative to the standard phase sensor 35, the standard phase sensor 35 detects a predetermined lift amount of the cam 10*a* between the base circle portion 50 and the cam lobe 51, and the detection signal of the standard phase sensor 35 is input as a signal indicative of the standard phase of the cam 10*a* to the NC control unit 33. The type of standard phase sensor 35, which can be used, may be any of a non-contact type and a contact type.

Figure 3:
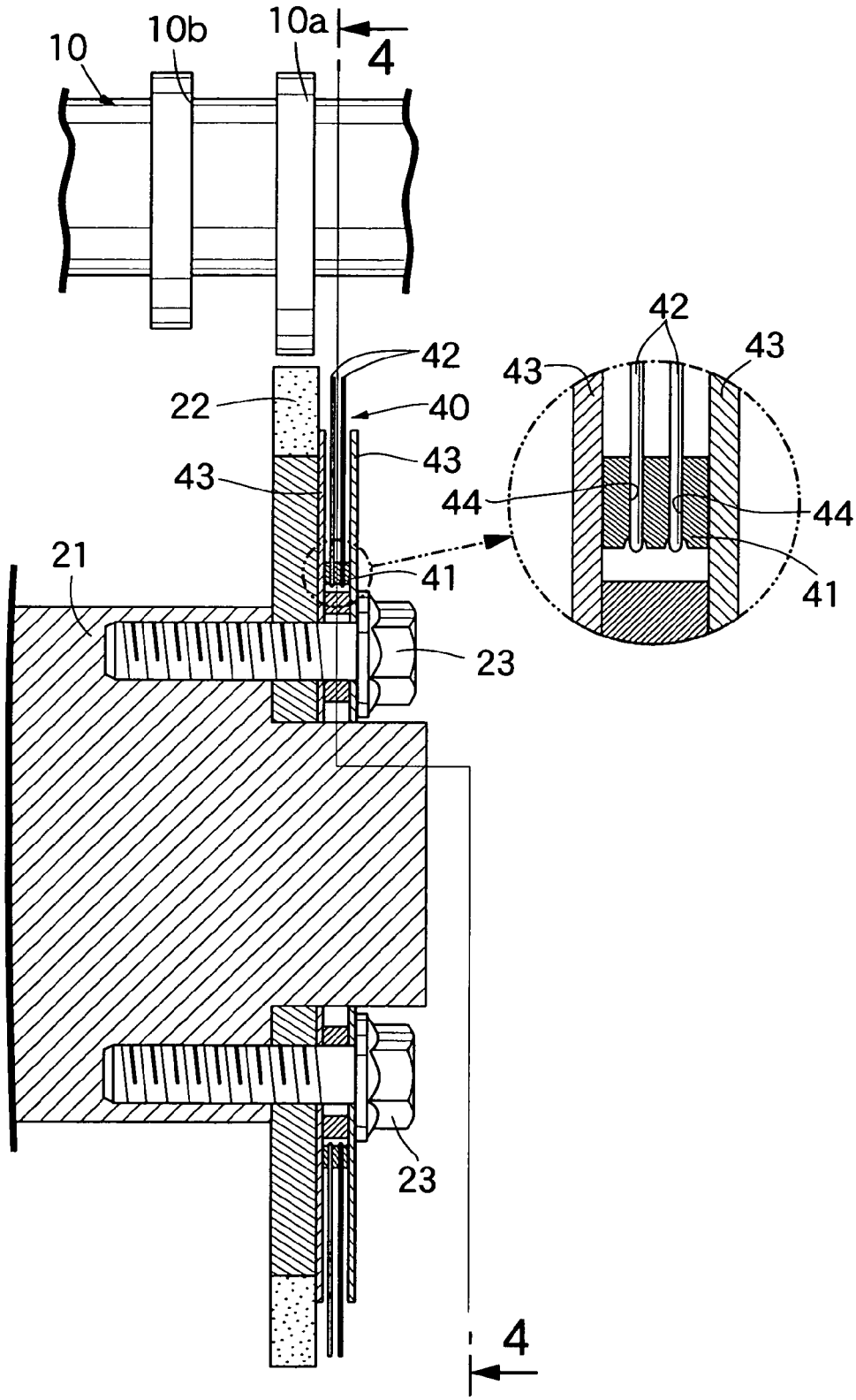
FIG. 3 is a sectional view taken along a line 3-3 in FIG. 2.
Figure 4:
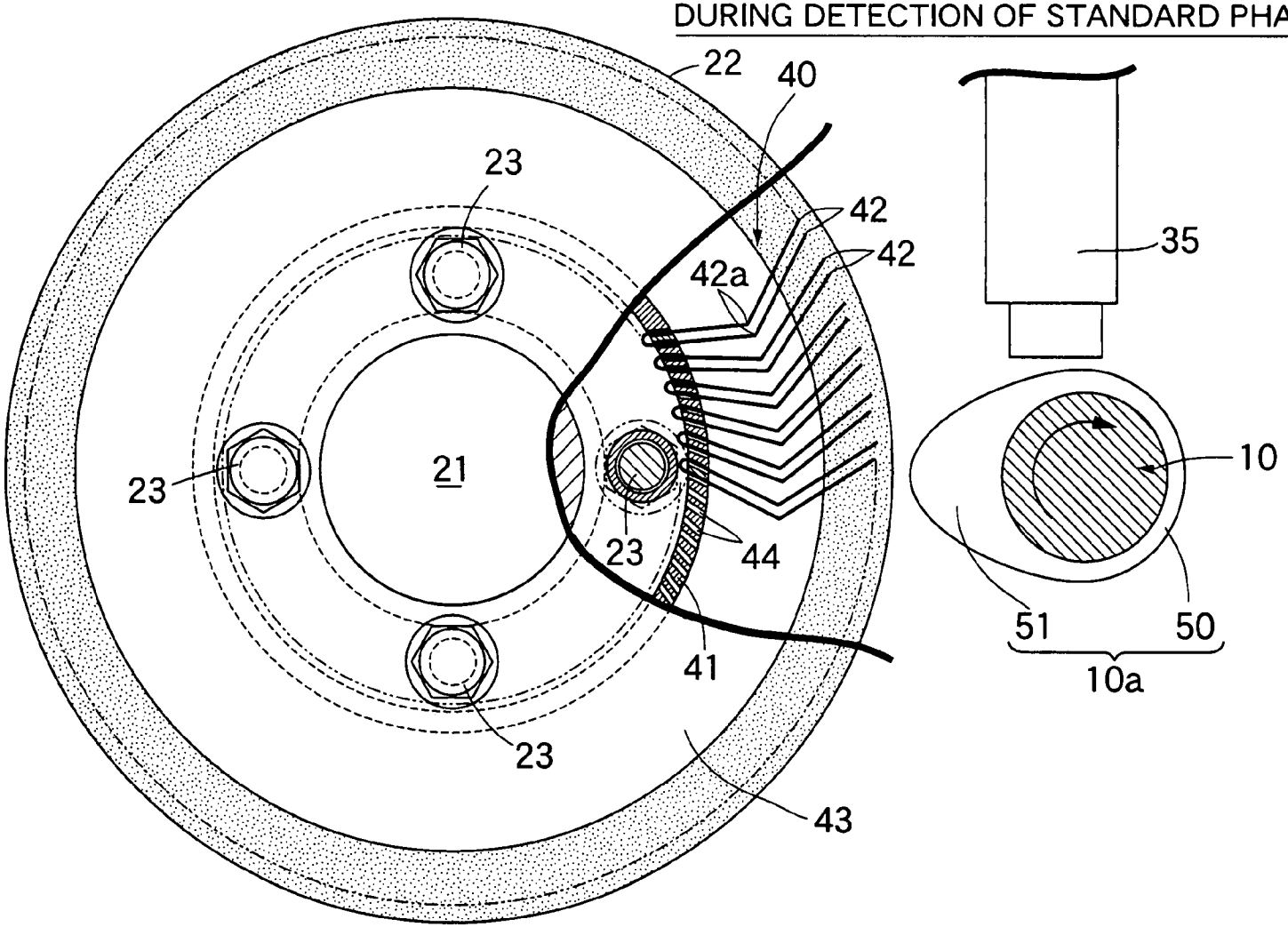
FIG. 4 is a sectional view taken along a line 4-4 in FIG. 3 (showing a cam whose standard phase is being detected)

As shown in FIGS. 3 and 4, a rotary brush 40 is mounted to the wheel spindle 21 adjacent the rotary grindstone 22. The rotary brush 40 is comprised of an annular brush body 41, a large number of metal wires 42, 42 as brush element wires embedded in the brush body 41, and a pair of wire-protecting plates 43, 43 opposed to opposite sides of the wires 42, 42, while clamping the brush body 41 therebetween. The brush body 41 and the wire-protecting plates 43, 43 are secured to the wheel spindle 21 along with the rotary grindstone 22 by the bolts 23, 23.

To embed the wires 42, 42, a large number of through-bores 44, 44 are made axially in a plurality of rows in the brush body 41 and arranged circumferentially of the brush body 41, and two tip ends of the wires 42, 42 each folded into two at the central portion are inserted through the every two circumferentially or axially adjacent through-bores 44, 44 from the side of the inner periphery of the brush body 41, and each of the wires 42 is adhesively bonded or brazed in each of the through-bores 44. Each of the wires 42 extends radially outwards from the brush body 41 and has a V-shape resilient bent portion 42*a*. When the wheel spindle 21 is in a stopped state or in a low-speed rotational state in which it is being rotated at a low speed lower than a usual grinding rotational speed, the tip end of each wire 42 is positioned at a location radially inside the outer peripheral surface of the rotary grindstone 22, but when the rotational speed of the wheel spindle 21 is increased to near the usual grinding rotational speed, the resilient bent portion 42*a* is stretched by a centrifugal force, so that the tip end of the wire is allowed to protrude radially outwards from the outer peripheral surface of the rotary grindstone 22 (see FIGS. 6 and 7). In this way, the rotary brush 40 is formed into a variable-diameter type in which its diameter, i.e., the diameter of the group of the wires 42, 42 can be decreased to smaller, or increased to larger than the outside diameter of the rotary grindstone 22.

As shown in FIGS. 1 to 5, a dressing motor 45 is mounted to a side of the head stock 5 closer to the movable table 11 with its output shaft 45*a* parallel to the main spindle 7, and a diamond dresser 46 capable of dressing the rotary grindstone 22 is mounted to the output shaft 45*a*.

The operation of the first embodiment will be described below.

Figure 5:
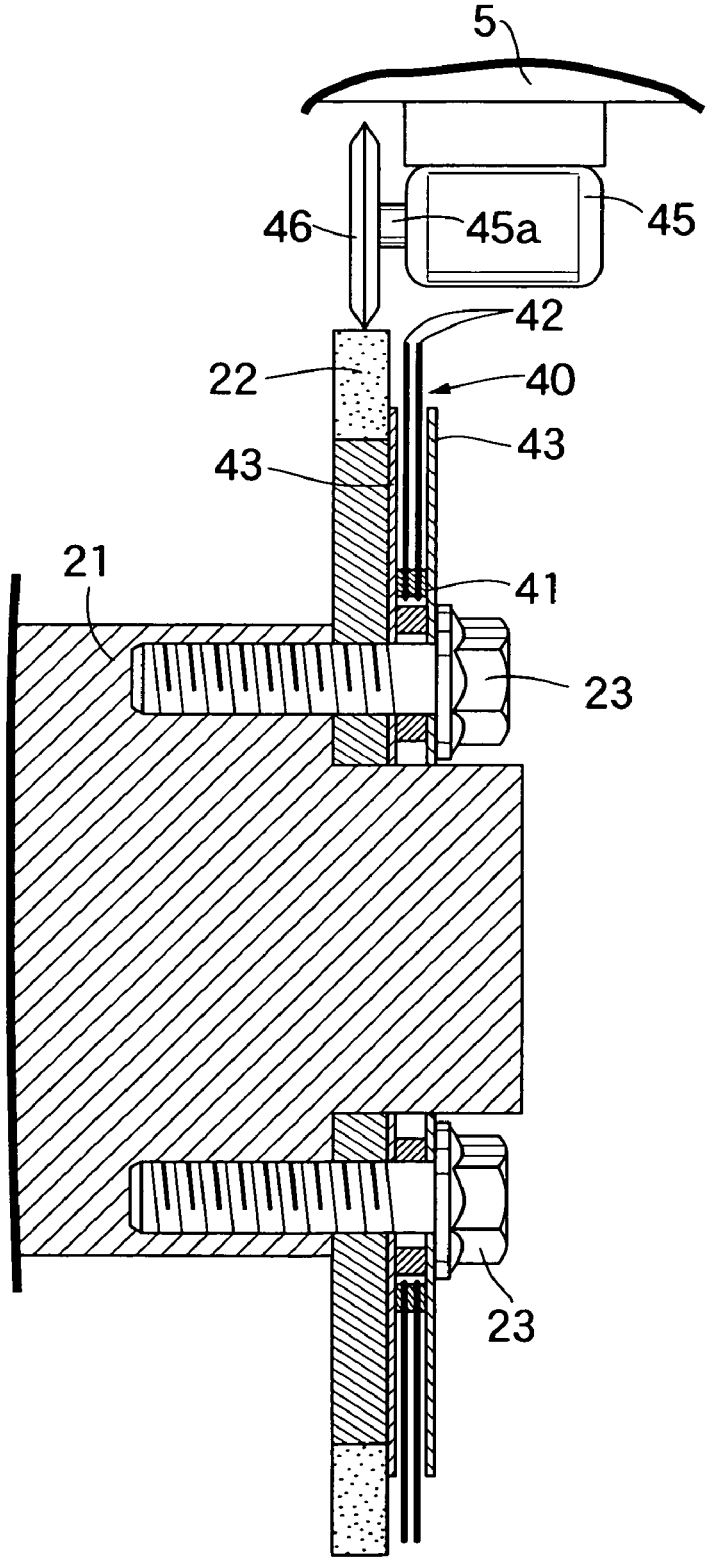
FIG. 5 is an enlarged view of a portion indicated by an arrow 5 in FIG. 1 (showing a rotary grindstone which is being dressed)

First, to carry out the dressing of the rotary grindstone 22, the outer peripheral surface of the rotary grindstone 22 rotated along with the wheel spindle 21 is brought into contact with the diamond dresser 46 and fed axially, while rotating the wheel spindle 21 at a low speed by the operation of the third electric motor 18 in a state in which the diamond dresser 46 is being rotated at a high speed by the operation of the dressing motor 45, as shown in FIG. 5.

During such dressing of the rotary grindstone 22, the rotational speed of the wheel spindle 21 is relatively low and hence, each of the wires 42 of the rotary brush 40 is in contracted state and thus, the diameter of the rotary brush 40 is smaller than that of the rotary grindstone 22. Therefore, it is possible to avoid the interference of the rotary brush 40 with the diamond dresser 46.

Now, to grind the outer peripheral surfaces of the plurality of cams 10*a*, 10*b* - - - 10*n* of the camshaft 10 formed by the precision casting, first of all, the opposite ends of the camshaft 10 are supported by the chuck 9 of the head stock 5 and the tail stock 19. Then, the sensor-supporting arm 37 is retained in the detecting position A, and the standard phase sensor 35 is opposed to the outer peripheral surface of the outermost cam 10*a* closest to the head stock 5 (see FIG. 4). The camshaft 10 is rotated at a very low speed through the chuck 9 by the first electric motor 8 on the head stock 5. When the base circle portion 50 and the cam lobe 51 of the cam 10*a* are moved past before a detecting portion of the standard phase sensor 35 in response to the rotation of the camshaft 10, the standard phase sensor 35 detects the predetermined lift amount of the cam 10*a*, and the detection signal is input as the standard phase signal to the NC control unit 33. Thereafter, the sensor-supporting arm 37 is turned immediately to the resting position B by the actuator 38 to move the standard phase sensor 35 away from the cam 10*a*. Thus, it is possible to avoid that the standard phase sensor 35 is exposed to a scattered grinding liquid.

When the standard phase signal is input to the NC control unit 33 from the standard phase sensor 35, the NC control unit 33 controls the operations of the first to fourth electric motors 8, 14, 18 and 31 based on the signal input from the camshaft rotated position sensor 34 and the data P, E and S previously input thereto to reciprocally move the movable table 11 in the Y-direction and feed it at the very low speed in the X-direction while rotating the rotary grindstone 22 at a predetermined grinding rotational speed, whereby the outer peripheral surface of the cam 10*a* is ground from one end to the other end by the rotary grindstone 22.

Figure 6:
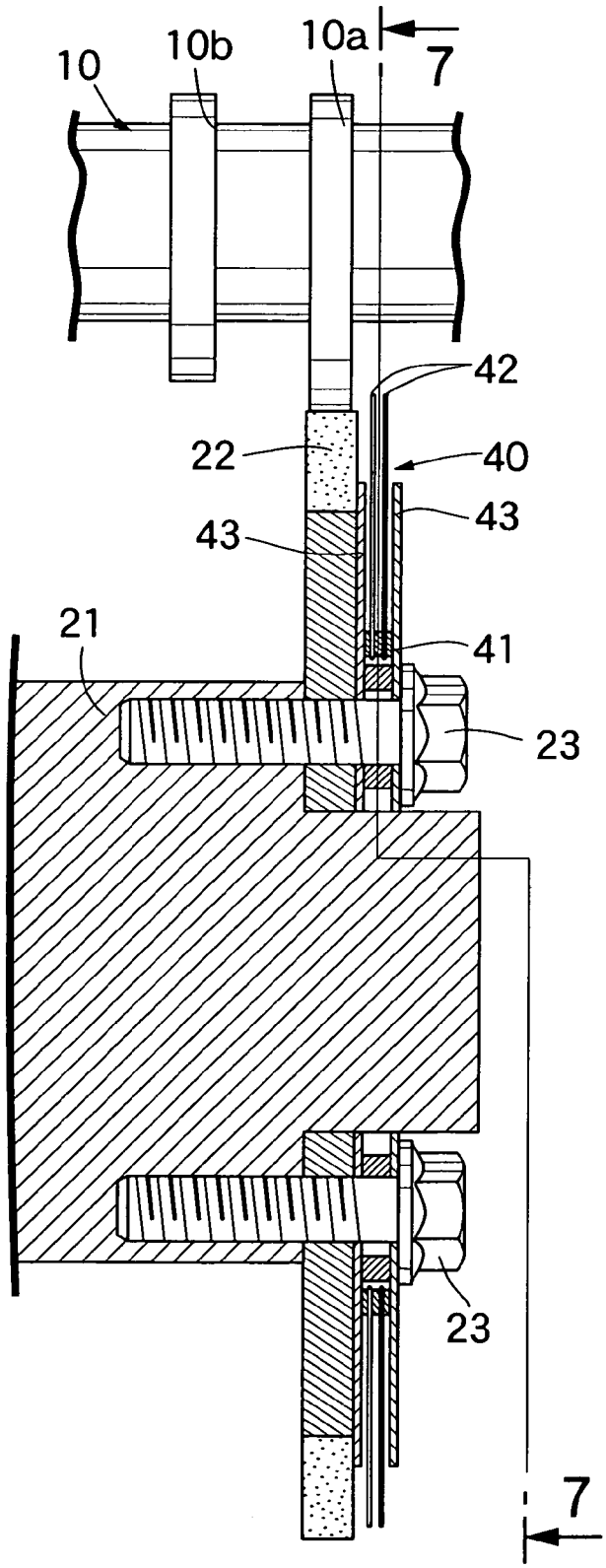
FIG. 6 is a view similar to FIG. 3, but showing a work which is being ground.
Figure 7:
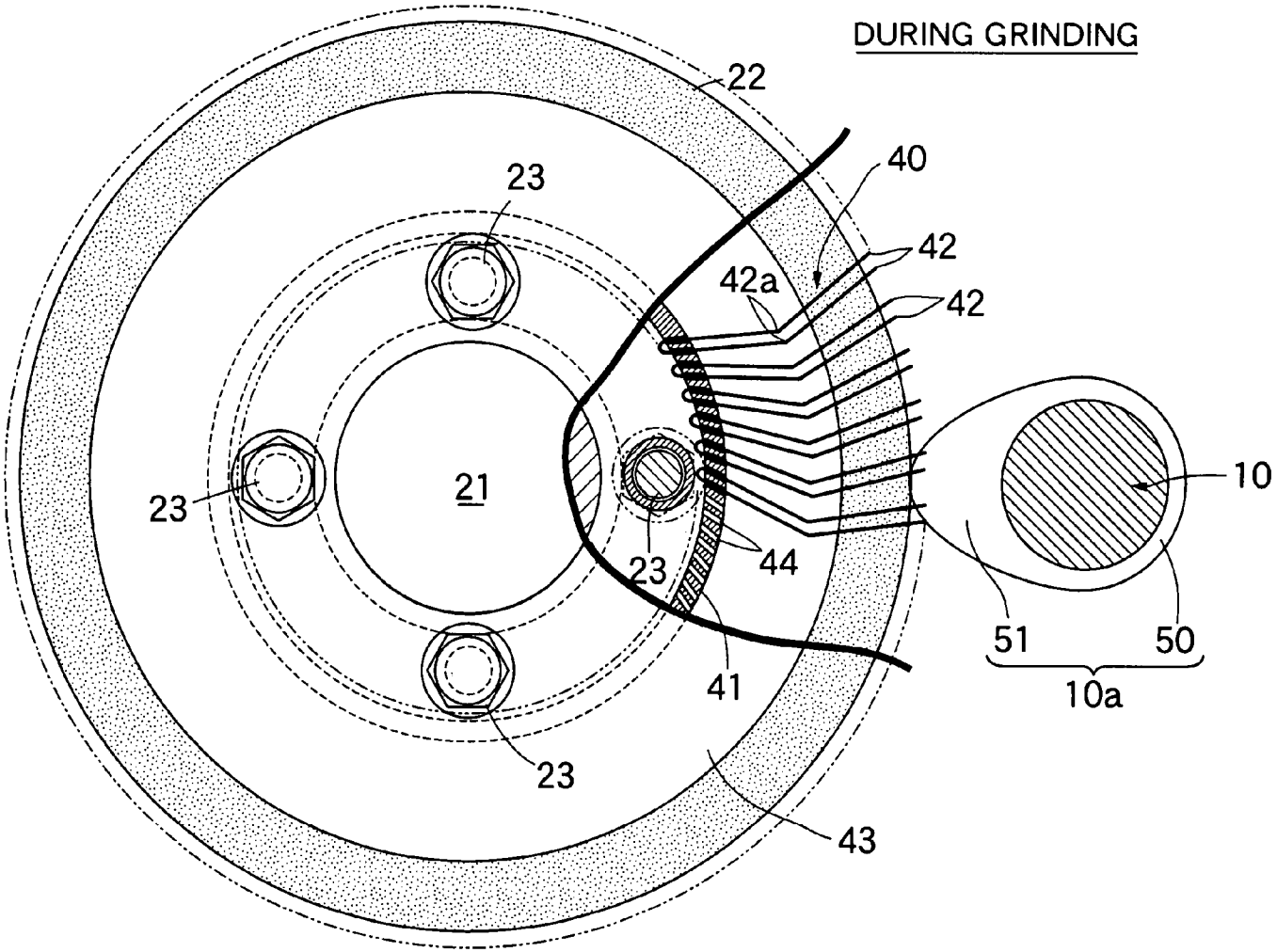
FIG. 7 is a sectional view taken along a line 7-7 in FIG. 6.
Figure 8:
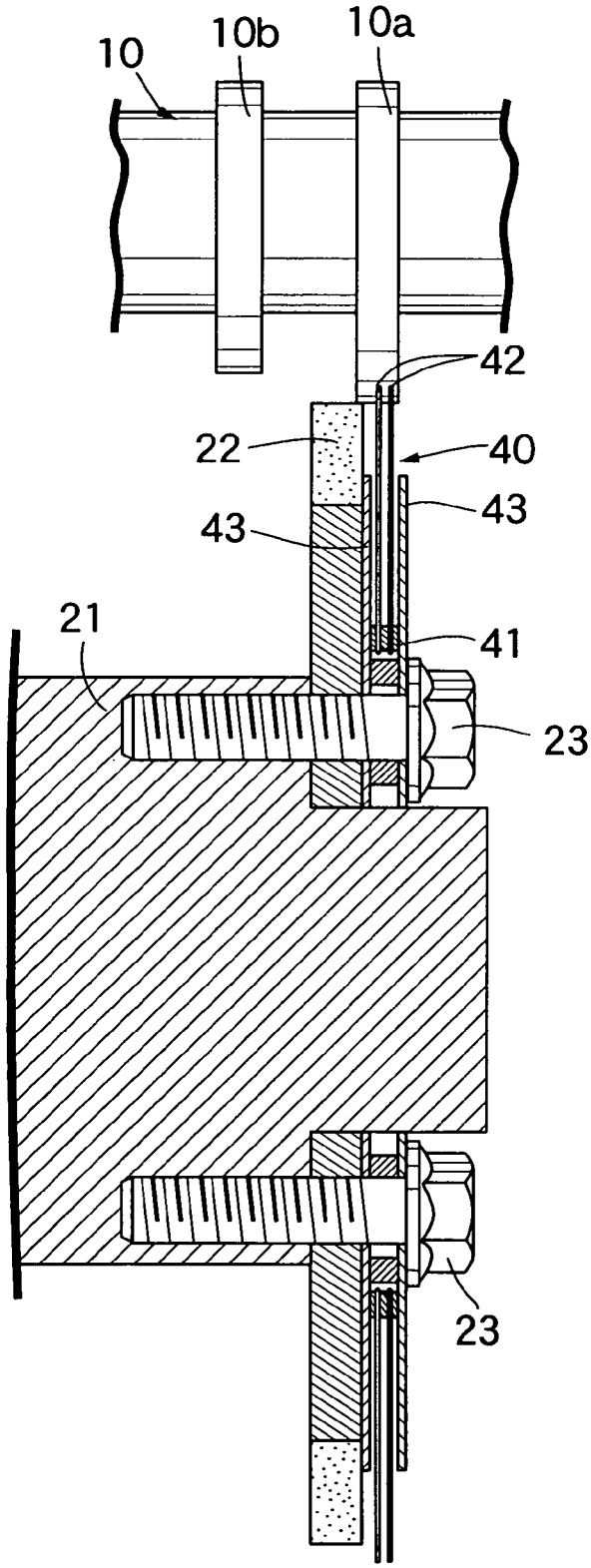
FIG. 8 is a view similar to FIG. 7, but showing the work which is being brushed.

During such grinding, the rotary brush 40 rotated at the relatively high speed along with the rotary grindstone 22 has a diameter increased to larger than that of the rotary grindstone 22 by stretching of the resilient bent portion 42*a* of each of the wires 42 due to a centrifugal force, as shown in FIGS. 6 and 7. Therefore, if the rotary grindstone 22 is fed in the X-direction subsequently to the grinding, the rotary brush 40 having the diameter larger than that of the rotary grindstone 22 can brush the ground surface of the cam 10*a* from one of its end edges toward other end edge, as shown in FIG. 8.

If the opposite end edges and the ground surface of the cam 10*a* are brushed carefully in the above-described manner, the removal of the ground flashes and the polishing of the ground surface can be achieved reliably subsequently to the grinding of the cam 10*a*. If the opposite end edges of the cam 10*a* are brushed concentratedly, the removal of the ground flashes can be achieved subsequently to the grinding of the cam 10*a*. If the ground surface of the cam 10*a* is brushed concentratedly, the polishing of the ground surface can be achieved subsequently to the grinding of the cam 10*a*.

If the grinding of the one cam 10*a* and the deflashing and/or the polishing are finished in the above-described manner, the NC control unit 33 actuates the fourth electric motor 31 to shift the connecting block 28 over only the distance between the adjacent cams 10*a*, 10*b* - - - 10*n* in the X-direction, whereby the next cams 10*b* - - - 10*n* are ground and deflashed and/or polished sequentially and simultaneously in a similar manner by the rotary grindstone 22 and the rotary brush 40.

Since the predetermined lift amount between the base circle portion 50 and the cam lobe 51 of the cam 10*a* is detected by the standard phase sensor 35, whereby the standard phase of the cam 10*a* is indexed, as described above, the indexing of the standard phase of the cam 10*a* can be performed properly even if a special recess is not formed around the outer periphery of the camshaft 10, thereby providing a decrease in grinding margin of the cam 10*a*, 10*b* - - - 10*n*, thus, a shortening of grinding time.

By continuously conducting the grinding, deflashing and/or polishing of the cam 10*a* - - - 10*n*, as described above, the detachment of the work, i.e., of the camshaft 10 is not required between these treatments. Thus, it is possible to remarkably shorten the machining time, as compared with the prior art in which a deflashing step and a polishing step are specially provided, thereby contributing to a reduction in machining cost, in cooperation with that exclusive deflashing and polishing devices as used in the prior art are not required either.

The rotary brush 40 is formed into a variable-diameter type by forming the resilient bent portion 42*a* on each of the wires 42 and hence, can be provided with a simple structure and at a low cost.

A second embodiment of the present invention shown in FIG. 9 will now be described.

The second embodiment is different from the previous embodiment in respect of the arrangement of a rotary brush 40. More specifically, through-bores 44, 44 are made in a brush body 41 and arranged circumferentially in a large number of sets with the adjacent two thereof disposed in a V-shape on opposite sides of a radius line R to form a pair. Two tip ends of a wire 42 bent into a V-shape at its central portion are inserted through each of the pairs of the through-bores 44, 44 from the side of an inner periphery of the brush body 41, and the wire 42 is brazed in each of the through-bores 44. The wire 42 bent into the V-shape is inclined with respect to the radius line R of the brush body 41 in its free state, so that its tip end is located radially inside the outer peripheral surface of the rotary grindstone 22, as shown by a solid line in FIG. 9, whereby the diameter of the rotary brush 40 is smaller than that of the rotary grindstone 22. However, when the wheel spindle 21 is brought into a predetermined high-speed rotational state, the wire 42 is allowed to rise toward the radius line R by a centrifugal force, as shown by a dashed line in FIG. 9, so that its tip end protrudes radially outwards from the outer peripheral surface of the rotary grindstone 22, whereby the diameter of the rotary brush 40 is larger than that of the rotary grindstone 22.

Therefore, as in the previous embodiment, in the low-speed rotational state of the wheel spindle 21, the dressing of the rotary grindstone 22 is possible without being obstructed by the rotary brush 40. In the high-speed rotational state of the wheel spindle 21, the grinding and the deflashing and/or polishing of each of the cams 10*a*, 10*b* - - - 10*n* of the camshaft 10 can be carried out by the rotary grindstone 22 and the rotary brush 40.

In addition, the rotary brush 40 formed with the large number of wires 42, 42 each bent into the V-shape on the opposite sides of the radius line R of the brush body 41 is also of a simple structure and hence, can be provided at a low cost.

Figure 9:
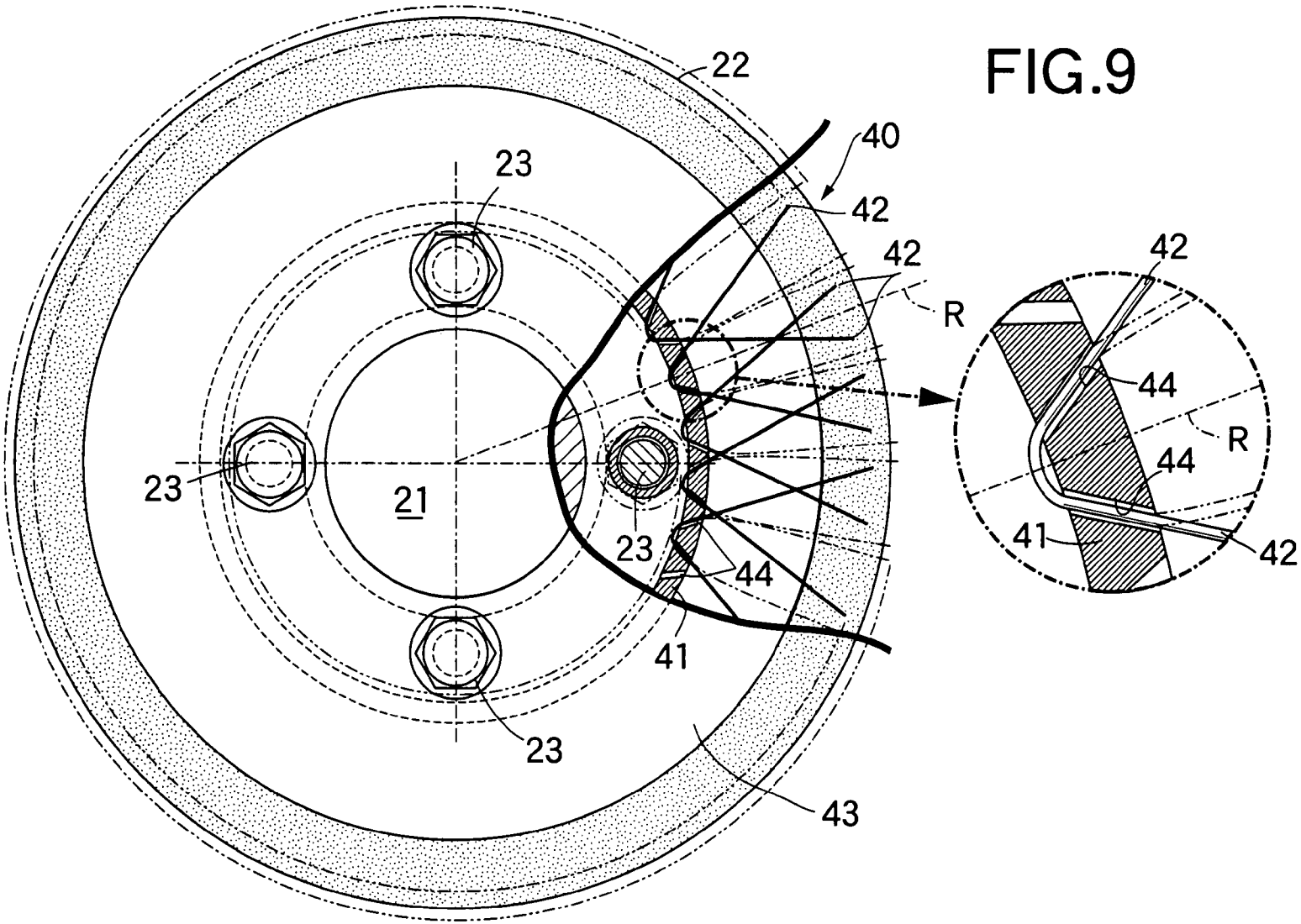
FIG. 9 is a view similar to FIG. 4, but showing a second embodiment of the present invention.

The arrangement of the other components is similar to that in the previous embodiment and hence, portions or components corresponding to those in the previous embodiment are designated by the same numerals and symbols in FIG. 9 and the description of them is omitted.

Finally, a third embodiment of the present invention shown in FIGS. 10 to 12 will be described.

In the third embodiment, a pair of rotary brushes 40, 40 are disposed adjacent on opposite sides of the rotary grindstone 22 and secured to the wheel spindle 21 along with the rotary grindstone 22 by a plurality of bolts 23, 23.

A large number of guide bores 52, 52 are made in a brush body 41 of each of the rotary brushes 40 to extend radially with its radially outer end opening into an outer peripheral surface of the brush body 41, and an annular groove 53 is formed on one side of the brush body 41 to permit radially inner ends of the guide bores 52, 52 to communicate all together. An annular retaining ring 54 is disposed within the annular groove 53, and a large number of bundles of wires 42 wound around the retaining ring 54 are disposed in the large number of guide bores 52, 52, so that their tip ends protrude to the outside of the guide bores 52, 52. An adhesive 55 is filled in the annular groove 53, whereby coupled portions of the retaining ring 54 and the wires 42 are fixed to the brush body 41. Each of the wires 42 is formed into a zigzag shape with a large number of resilient bent portions 42*a*, 42*a* arranged in a line so as to be capable of expanding and contracting, and when each wire 42 is in a free state, it has been contracted, whereby the diameter of the rotary brush 40 is smaller than that of the rotary grindstone 22, as shown in FIGS. 10 and 11. However, when the wheel spindle 21 is brought into a predetermined high-speed rotational state, each of the wires 42 is stretched by a centrifugal force, whereby the diameter of the rotary brush 40 is larger than that of the rotary grindstone 22, as shown in FIG. 12.

Therefore, in the low-speed rotational state of the wheel spindle 21, the dressing of the rotary grindstone 22 is possible without being obstructed by the rotary brush 40 as in the first embodiment. In the high-speed rotational state of the wheel spindle 21, the grinding and the deflashing and/or polishing of each of the cams 10*a*, 10*b* - - - 10*n* of the camshaft 10 can be conducted by the rotary grindstone 22 and the rotary brush 40.

In addition, the rotary brush 40 formed of the large number of wires 42, 42 disposed radially and each bent into the zigzag shape is also of a simple structure and hence, can be provided at a low cost.

Since the pair of rotary brushes 40, 40 are disposed adjacent on the opposite sides of the rotary grindstone 22, even when the camshaft 10 is ground from any of left and right directions, the removal of ground flashes and/or the polishing is possible, which is advantageous.

Figure 10:
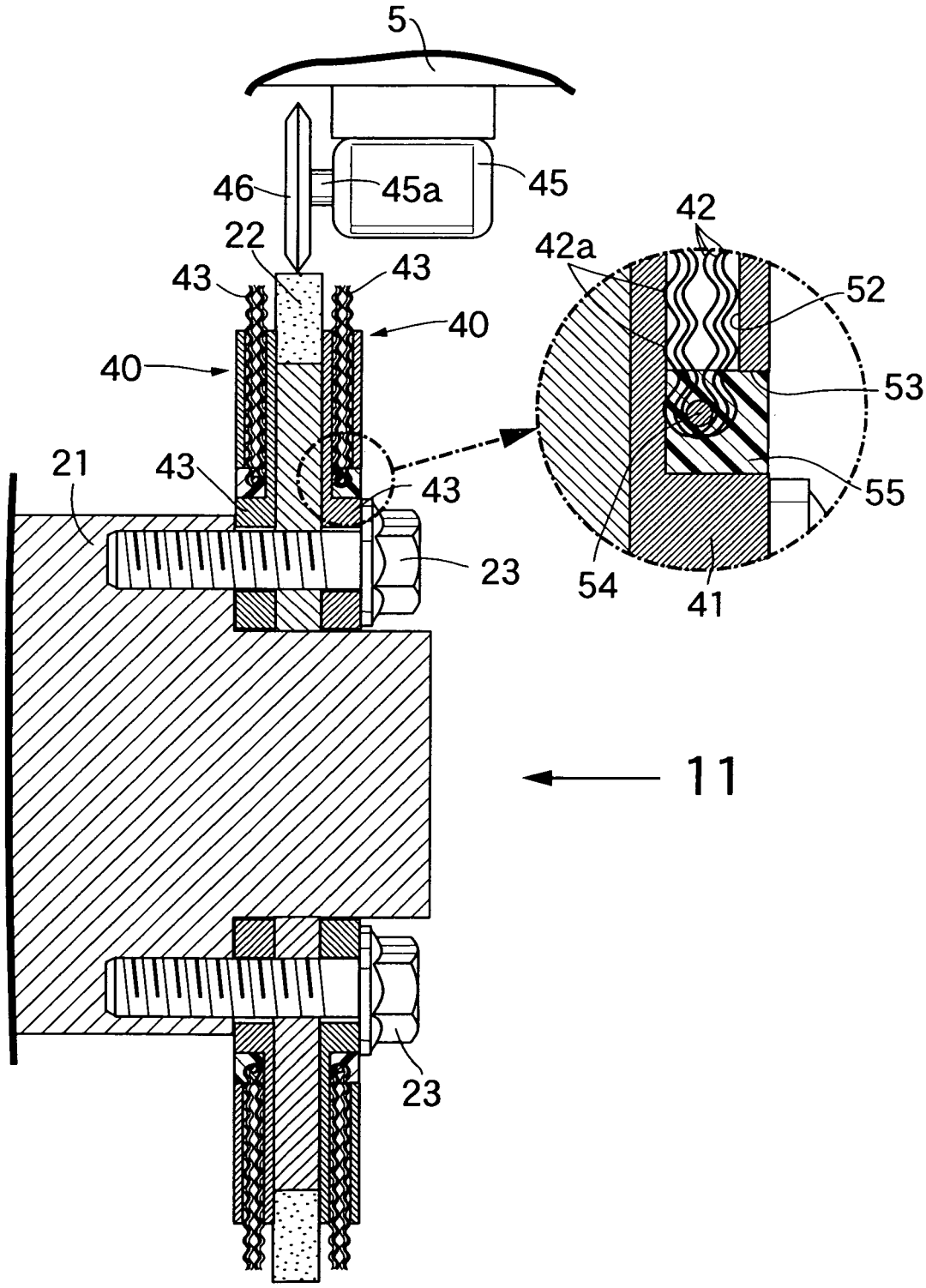
FIG. 10 is a view similar to FIG. 5, but showing a third embodiment of the present invention (showing a rotary grindstone which is being dressed)
Figure 11:
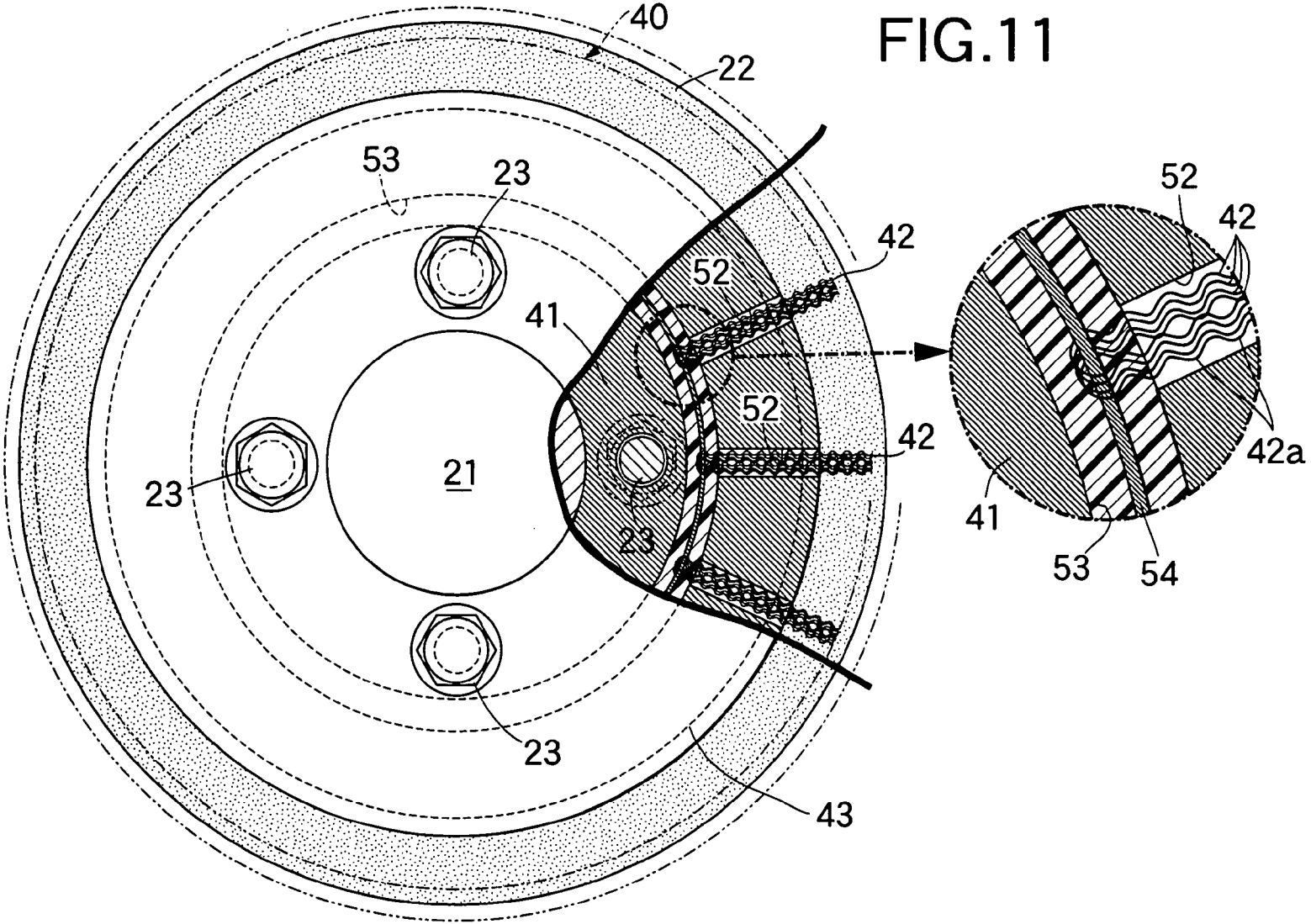
FIG. 11 is a view taken in the direction of an arrow 11 in FIG. 10.
Figure 12:
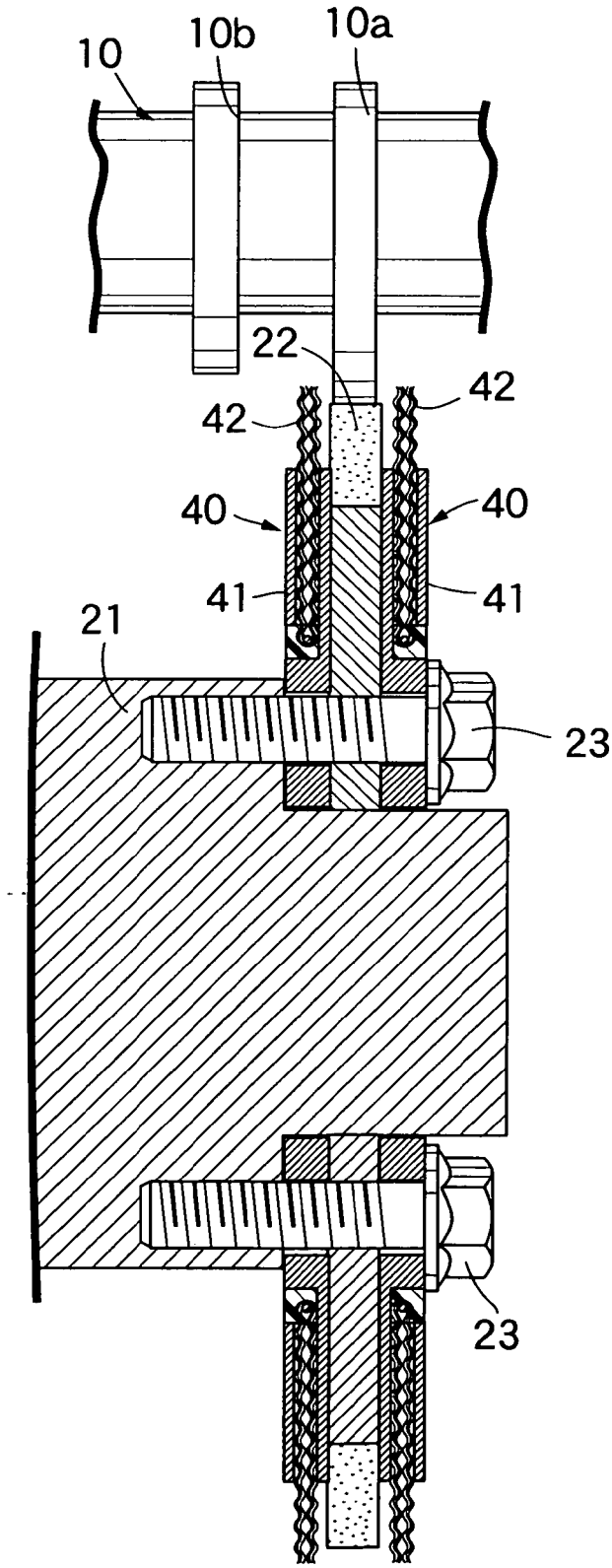
FIG. 12 is a view similar to FIG. 11, but showing a work which is being ground.

The arrangement of the other components is similar to those in the previous embodiments and hence, portions or components corresponding to those in the previous embodiments are designated by the same numerals and symbols in FIGS. 10 to 12 and the description of them is omitted.

Although the preferred embodiments of the present invention have been described in detail, it will be understood that various modifications in design may be made without departing from the scope of the invention defined in claims. For example, in the rotary brush 40 in the first embodiment, the wire-protecting plate 43 closer to the rotary grindstone 22 can be disused, and the rotary grindstone 22 can serve as a wire-protecting member. A brush element wire made of a synthetic resin can be used for the rotary brush 40 in place of each of the wires 42, 42 made of the metal. The standard phase sensor 35 may be mounted at a place other than the grindstone 20 such as the table 2. To conduct the grinding, the deflashing and/or polishing of the work 10 in the above-described embodiment, the rotary brush 40 is moved axially relative to the work 10, but the work 10 may be moved axially.

What is claimed is:

1. A process for grinding an outer peripheral surface of a rotated work by a rotary grindstone rotated by a wheel spindle, the process comprising the following steps:

coaxially mounting a rotary brush with and to one side of said rotary grindstone so as to be rotated along with said rotary grindstone, grinding said work by said rotary grindstone and then moving said rotary grindstone and said work axially relative to each other, and then brushing a ground surface of said work by said rotary brush to polish the ground surface of said work.

2. A process for grinding an outer peripheral surface of a rotated work by a rotary grindstone rotated by a wheel spindle, the process comprising the following steps:

coaxially mounting a rotary brush with and to one side of said rotary grindstone so as to be rotated along with said rotary grindstone, grinding said work by said rotary grindstone and then moving said rotary grindstone and said work axially relative to each other, and then brushing end edges of a ground surface of said work by said rotary brush to remove a ground flash of said work.

3. A process for grinding an outer peripheral surface of a rotated work by a rotary grindstone rotated by a wheel spindle, the process comprising the following steps:

coaxially mounting a rotary brush with and to one side of said rotary grindstone so as to be rotated along with said rotary grindstone, grinding said work by said rotary grindstone and then moving said rotary grindstone and said work axially relative to each other, and then brushing the entire ground surface of said work from end edges of the ground surface by said rotary brush to remove a ground flash of said work and to polish the ground surface.

4. A grinding apparatus including a rotary grindstone mounted to a wheel spindle to grind an outer peripheral surface of a work by the rotation of the rotary grindstone, the grinding apparatus comprising:

a rotary brush coaxially mounted with and adjacent to said rotary grindstone for brushing the work having a diameter larger than that of said rotary grindstone and ground by said rotary grindstone.

5. A grinding apparatus according to claim 4, wherein said rotary brush has a variable-diameter, so that when said wheel spindle is rotated at a low speed lower than a grinding rotational speed of said rotary grindstone, the diameter of said rotary brush is smaller than that of said rotary grindstone, but when said wheel spindle is rotated at a speed equal to said grinding rotational speed, the diameter of said rotary brush is larger than that of said rotary grindstone.

6. A grinding apparatus according to claim 5, wherein said rotary brush is comprised of a brush body mounted adjacent to said rotary grindstone, and a brush element wire embedded in an outer periphery of said brush body, said brush element wire having contraction and expansion properties provided thereto, so that when said brush element wire is in a free state, said brush element wire is in a contracted state in which the diameter of said rotary brush is smaller than that of said rotary grindstone, and when said wheel spindle is rotated at a predetermined rotational speed or more, said brush element wire is expanded by a centrifugal force, whereby the diameter of said rotary brush is larger than that of said rotary grindstone.

7. A grinding apparatus according to claim 6, wherein a single or a plurality of resilient bent portions are formed on said brush element wire to provide the contraction and expansion properties to said brush element wire.

8. A grinding apparatus according to claim 5, wherein said rotary brush is comprised of a brush body mounted adjacent to said rotary grindstone and a brush element wire embedded in an outer periphery of said brush body, said brush element wire being disposed so that when said brush element wire is in a free state, said element wire is inclined with respect to a radius line (R) of said brush body, so that the diameter of said rotary brush is smaller than that of said rotary grindstone, but when said wheel spindle is rotated at a predetermined rotational speed or more, said brush element wire is allowed to rise toward said radius line (R) by a centrifugal force, so that the diameter of said rotary brush is larger than that of said rotary grindstone.

* * * * *